US006959560B2

(12) United States Patent
Weikel et al.

(10) Patent No.: US 6,959,560 B2
(45) Date of Patent: Nov. 1, 2005

(54) BAFFLED AIR FLOW SYSTEM FOR PEG BAR REFRIGERATED MERCHANDISER

(75) Inventors: Jerry L. Weikel, Granger, IN (US); Michael J. Kempiak, Osceola, IN (US)

(73) Assignee: Carrier Commercial Refrigeration, Inc., Aurora, IL (US)

( * ) Notice: Subject to any disclaimer, the term of this patent is extended or adjusted under 35 U.S.C. 154(b) by 135 days.

(21) Appl. No.: 10/288,885

(22) Filed: Nov. 6, 2002

(65) Prior Publication Data

US 2004/0083749 A1 May 6, 2004

(51) Int. Cl.[7] ..... A47F 3/04
(52) U.S. Cl. ..... 62/255; 62/256
(58) Field of Search ..... 62/255, 256

(56) References Cited

U.S. PATENT DOCUMENTS

| | | | | |
|---|---|---|---|---|
| 2,936,596 A | | 5/1960 | Rainwater | |
| 3,256,709 A | | 6/1966 | Stepleton | |
| 3,306,068 A | | 2/1967 | Allgeyer et al. | |
| 3,369,375 A | * | 2/1968 | Gerweck et al. | 62/256 |
| 3,584,467 A | * | 6/1971 | Barroero | 62/252 |
| 3,827,254 A | * | 8/1974 | MacMaster et al. | 62/256 |
| 4,303,217 A | | 12/1981 | Garfinkle | |
| 4,526,335 A | | 7/1985 | Garfinkle | |
| 4,591,057 A | | 5/1986 | Garfinkle | |
| 4,606,466 A | * | 8/1986 | Fredrickson | 211/59.1 |
| 4,615,503 A | | 10/1986 | Garfinkle | |
| 4,951,057 A | * | 8/1990 | Nagel | 342/51 |
| 5,502,979 A | * | 4/1996 | Renard | 62/256 |
| 6,014,867 A | * | 1/2000 | Fløysvik | 62/255 |
| 6,619,052 B1 | * | 9/2003 | Nash, Jr. | 62/89 |
| 2001/0003248 A1 | * | 6/2001 | Otto et al. | 62/255 |
| 2003/0084676 A1 | * | 5/2003 | Thurman | 62/256 |

FOREIGN PATENT DOCUMENTS

DE 100 40 250 A1 2/2002

* cited by examiner

*Primary Examiner*—William E. Tapolcai

(57) ABSTRACT

A refrigerated merchandiser includes a display case 10 having an open front and defining a product display space 30 wherein product 15 is hung for display and customer access on a peg bar support system 50. Refrigerated air passes into the product display space 30 through a back panel 24 perforated with air inlet holes 48. A baffle plate 60 lies superadjacent the peg bar support system 50 and is positioned relative thereto so as to provide an airflow gap 65 between its rearward edge 64 and the back panel 24 and an airflow gap 63 between its forward edge 62 and the tag moulding 58 of the peg bar support system 50. Refrigerated air passes through the rearward and forward airflow gaps to cool the product displayed on the peg bar support system. Additionally, the baffle plate may be perforated with a plurality of holes to provide additional airflow passages 70 through which further refrigerated air may pass to cool the product displayed on the peg bar support system.

10 Claims, 3 Drawing Sheets

BAFFLED AIR FLOW SYSTEM FOR PEG BAR REFRIGERATED MERCHANDISER

BACKGROUND OF THE INVENTION

This invention relates generally to refrigerated display case. More particularly, the invention relates to an air flow system for a refrigerated merchandiser of the type wherein foods products, for example pre-packaged perishable food products, such as cheese slices, sandwich meat slices, bacon and the like are hung on a peg bar display system.

Refrigerated merchandisers, commonly referred to as display cases, found in supermarkets, grocery stores and convenience stores may be provided with a peg bar display system wherein pre-packaged, perishable food products, such as cheese slices, sandwich meat slices, bacon and the like, are displayed within an open viewing area. In a typical peg bar display system, such as the prior art peg bar display system 50' illustrated in FIG. 1, a transversely extending structural bar 52' is mounted to the back wall of the display case. This structural bar supports, in a cantilevered manner, a plurality of rods 54' that extend outwardly from the structural bar 52' into the viewing area. The pre-packaged food products being displayed are hung on these rods 54', generally by means of slipping a hole in a tab portion extending from the product package over the rod 54'. Additionally, the structural bar 52' supports, again in a cantilevered manner, rods 56' that support a price tag molding 58' that extends transversely across the displayed products, superadjacent the distal ends of rods 54'. To retrieve a food product package from the open viewing area, the consumer may reach into the display case, without opening a door, and simply slide the package off its support rod 54'.

To keep the product refrigerated within the display case, these open-front refrigerated merchandisers customarily have an air curtain that extends from near the top to near the bottom of the display case over the viewing area. Typically, this air curtain is formed by cold air flowing generally vertically downwardly from an outlet at the top of the front of the display case to a warm air return near the bottom of the display case. This air is drawn into the warm air return by a fan that then blows the warmed air over the refrigerated tube coil of a refrigeration evaporator and recycles the air back to the air outlet at the top of the display case through a supply duct that extends along the back wall and across the roof of the display case. Generally, the back wall of the display case is perforated with a plurality of holes that open into the supply duct, whereby a portion of the refrigerated air passing through the supply duct passes through these holes in the perforated back wall of the display case to enter directly into the product viewing area.

Despite the downwardly directed air curtain flowing over the front of the display case and the refrigerated air entering the display case through its perforated rear wall, packaged product disposed at the front of the display case on the distal, that is forward, portion of the rods may not be sufficiently cooled. Product displayed on the rods near the front of the display case may be too warm due to radiant heat from the store, shelf lights located at the front of the display, and ambient air infiltration from the area in front of the case. In an attempt to improve the cooling of packaged product displayed on the forward portion of the rods, it is known in the art to position a flow impervious baffle 60' superadjacent the peg bar display system 50', the baffle abutting the rear wall of the display case and extending forwardly to contact the back of the price tag molding as depicted in prior art FIG. 2. The flow impervious baffle serves to direct the air flow entering the display case through the holes in the perforated back wall of the display case essentially horizontally forwardly towards the front of the display case and precludes that air flow from passing downwardly before it reaches the front of the display case. While improving the cooling of the forward positioned product, such conventional flow impervious baffles have not been effective to fully solve the problem of insufficient cooling of the forward positioned product due to warm air infiltration and radiant heat from the store and heat from display lighting.

Accordingly, there still exists a need to improve air flow distribution in the product view area of a display case having a peg bar display system so that forwardly positioned product is sufficiently cooled.

SUMMARY OF THE INVENTION

In accordance with the present invention, a baffle plate is disposed superadjacent the peg bar display so as to extend forwardly from its trailing edge, which extends along the perforated back wall of the display case, to its leading edge, which is positioned in spaced from the price tag molding, thereby establishing a forward flow gap therebetween. When cool refrigerated air passing along the upper surface of the baffle reaches the leading edge of the baffle, the cool refrigerated air drops through the forward air gap to flow over the forwardly positioned product disposed on the forward portion of the pegs near the front of the display case.

In a further embodiment of the invention, the trailing edge of the baffle plate, while extending along the perforated back wall of the display cabinet, does not abut, but rather is disposed in spaced relationship from the back wall of the display case thereby establishing a rearward flow gap therebetween. A portion of the cool refrigerated air entering the display case through the air flow holes in the back wall of the display case passes through the rearward flow gap to flow over product hanging from pegs below the baffle plate.

In a still further embodiment of the invention, the baffle plate has a plurality of holes passing therethrough through which a further portion of cool refrigerated air passing over the upper surface of the baffle may passing downwardly through the holes to flow over product hanging from pegs below the baffle plate. By selecting the number and relative sizes of the plurality holes extending through the baffle flow and the distribution of these holes over the area of the baffle plate, the amount and the relative distribution of the air flow passing through the baffle plate between its leading and trailing edges may be controlled. Further, by selecting the respective widths of the forward and rearward flow gaps, the flow areas provided by those gaps may be established as desired to fully control the relative distribution of cool refrigerated air flow amongst the forward gap, the rearward gap, and the plurality of holes provided between the trailing and leading edges of the baffle plate. Accordingly, not only is the flow of sufficient cool refrigerated air to the forward positioned assured, but also the distribution of cool refrigerated air to the product hanging on pegs beneath the baffle may be selectively controlled from the rear to the front of the display case.

BRIEF DESCRIPTION OF THE DRAWINGS

The various features and advantages of this invention will become apparent to those skilled in the art from the following detailed description of the currently preferred embodiment and the accompanying drawings. The drawings that accompany the detailed description can be briefly described as follows.

DETAILED DESCRIPTION OF THE PREFERRED EMBODIMENT

Figure 1:
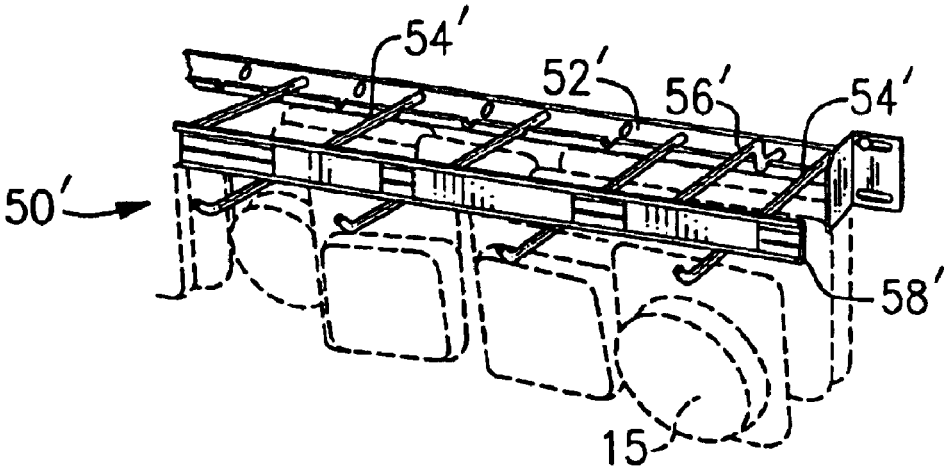
FIG.1 Prior Art
FIG. 1 is a perspective view of a conventional prior art peg bar display system.
Figure 2:
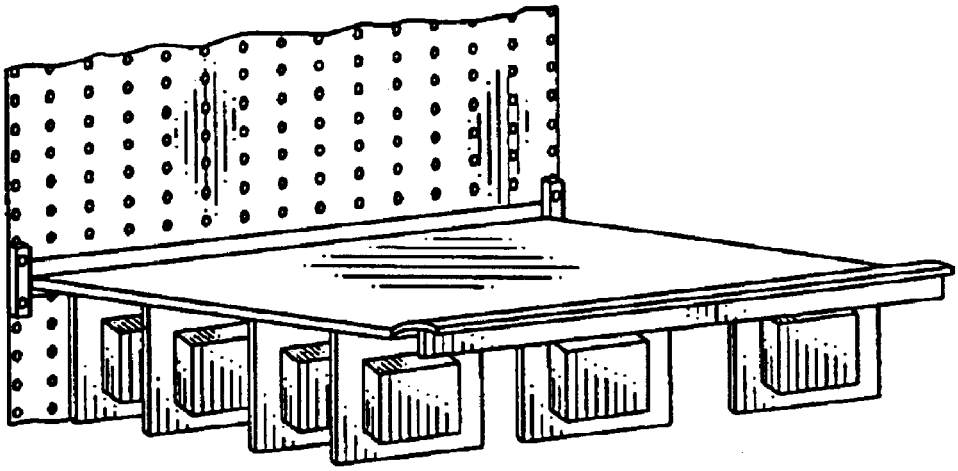
FIG.2 Prior Art
FIG. 2 is a perspective view of a conventional peg bar airflow system incorporating a prior art flow impervious baffle plate disposed superadjacent the peg bar, display system.
Figure 3:
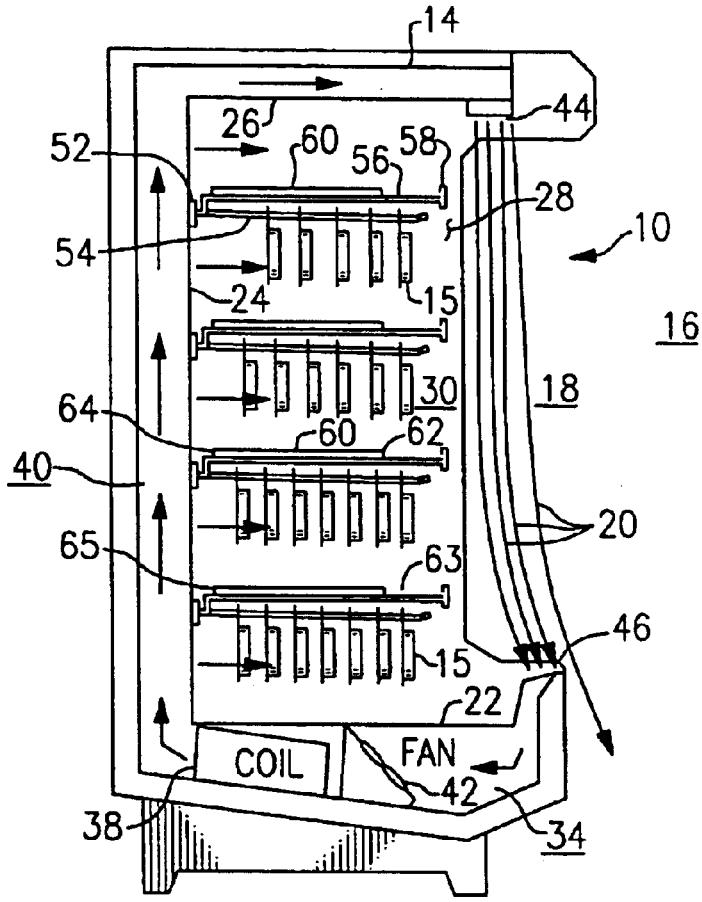
FIG. 3 is a side elevation view of a refrigerated display case equipped with the improved peg bar airflow systems in accordance with the present invention.
Figure 4:
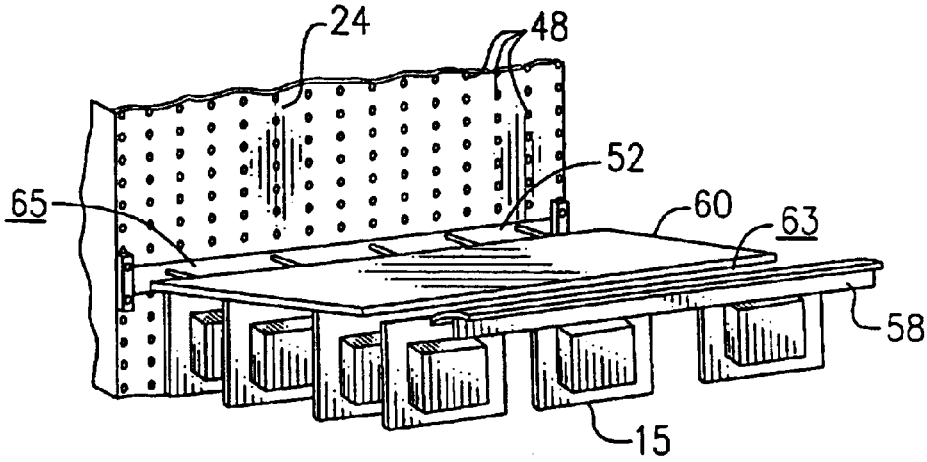
FIG. 4 is a respective view of the peg bar airflow system of the present invention.

Referring now FIGS. 3 and 4, the refrigerated display case 10 constitutes a housing 14 having an open front area 18, a floor panel 22, a back panel 24, a top panel 26 and side panels 28, which collectively encompassed a product display space 30 wherein product for sale is placed for viewing and access by the consumer. Consumers self-serve by simply reaching into display case 10 to retrieve product 15 displayed therein. An airflow passage 40 extends around and adjacent the floor panel 22, the back panel 24 and the top panel 26. Refrigerated air flows from passage 40 through a perforate grill at the outlet 44 to the airflow passage to pass generally vertically downwardly over the open front area 18 of the display case 10 to reenter the airflow passage 40 through a perforate grill at the inlet 46 to the airflow passage. As in conventional practice, the refrigerated air flowing downwardly over the open front area 18 of the display case 10 establishes an air curtain 20 that separates the refrigerated display space 30 from the ambient air 16 in the store.

One or more circulating fans 42 and an evaporator 38 are located in the airflow passage 40, advantageously in a compartment 34 formed within the lower portion of the display case and separated from the display space 30 by the floor panel 22. The evaporator 38 may be of conventional design, for example a finned tube coil, and extend across the width of the display case 10 as a single piece evaporator or a plurality of separate evaporators. The evaporator 38 is operatively connected with conventional condensing equipment (not shown) disposed externally of the display case 10 in usual fashion at another location in the store, on the store roof, or otherwise as normally located. The circulating fan or fans 42 circulate air through the airflow passage 40 and through the evaporator 38, wherein the air is cooled in a conventional manner as it traverses the evaporator 38 by heat exchange with refrigerant passing from the condensing equipment through the tubes of the evaporator coil. This refrigerated air is delivered to the display space 30 through a plurality of holes 48 provided in the back panel 24 which separates the display space 30 from the airflow passage 40 as the airflow passage extends upwardly along the back panel 24.

As depicted in the drawing, the product being displayed in the display area 30 of the display case 10, such as for example pre-packaged luncheon meat, is suspended from a peg bar support system 50. The peg bar support system 50 may be of conventional design such as, for example, as disclosed in U.S. Pat. No. 4,951,057 to Garfinkle or U.S. Pat. No. 4,606,466 to Fredrickson, the entire disclosures of which are incorporated herein by reference. Product suspended on the peg bar support system is cooled by refrigerated air flowing through the display space 30. This refrigerated air passes from the airflow passage 40 through the holes 48 in the back panel 24 and exits the display area through the airflow passage inlet 46.

The peg bar support system 50 is of the conventional type and includes a support bar 52 and a plurality of supporting rods 54 and 56. The support bar 52 is fixedly attached at each of its ends to the back panel 24 via a support bracket 56. The rods 54 and 56 are supported from the support bar 52 in a cantilevered fashion to extend outwardly therefrom into the product display space 30. The rods 54 provide means for supporting the product 15 by suspension in the conventional manner. The rods 56, which extend outwardly in the product space 30 to a greater extent than the product support rods 54, support a tag moulding 58 on which product identification and pricing information tags may be mounted for display to the customer.

Figure 5:
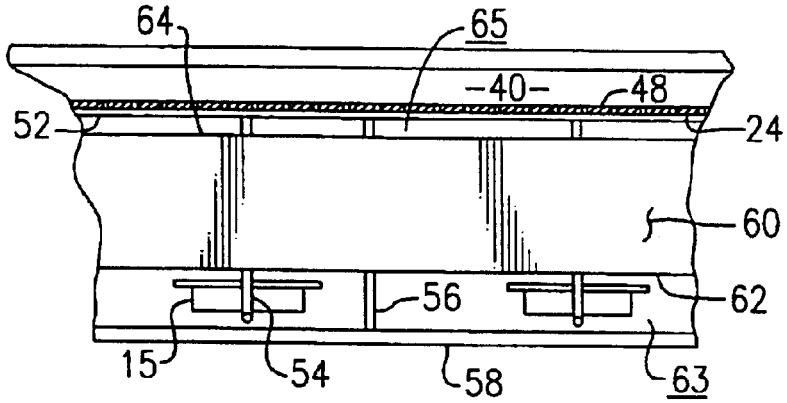
FIG. 5 is a plan view of one embodiment of the flow baffle of the peg bar airflow system of the present invention.

An airflow baffle plate 60 is disposed superadjacent the support rods 54 of the peg bar support system 50, advantageously extending across substantially the entire width of the display case 10. In accordance with the present invention the airflow baffle 60 is foreshortened, that is the airflow baffle 60 has a depth which is less than the distance between the back panel 24 bounding the rear of the display space 30 of the display case 10 and the tag moulding 58 disposed near the front of the display space 30. As best seen in FIGS. 4 and 5, the foreshortened baffle plate 60 is disposed with its forward edge 62 in spaced relationship with and behind the tag moulding 58 thereby defining an airflow gap 63 between the forward edge 62 of the baffle plate 60 and the tag moulding 58. The airflow gap 63 provides an airflow path through which a portion of the airflow over the baffle plate 60 may flow downwardly over the first rows or first few rows of the product 15 hanging on the forward portion of the product support rods 54. This extra airflow serves to improve the cooling of the product 15 by countering the effect of the heat from any lighting that may be positioned in the forward region of the display area 30 and from the impact of any ambient air that may be entrained into the air curtain 20 flowing downwardly over the front of the display space 30.

Advantageously, the baffle plate 60 may also be disposed with its rearward edge 64 in spaced relationship with and forward of the back panel 24 of the display case 10 thereby defining a second airflow gap 65 between the rearward edge 64 of the baffle plate 60 and the back panel 24 of the display case 10. The airflow gap 65 provides an airflow path through which a portion of the airflow passing into the display space 30 through the holes 48 in the back panel 24 may pass into the back region of the display space 30 immediately beneath the baffle plate 60 to flow over product 15 hanging on the rearward portion of the product support rods 54.

Figure 6:
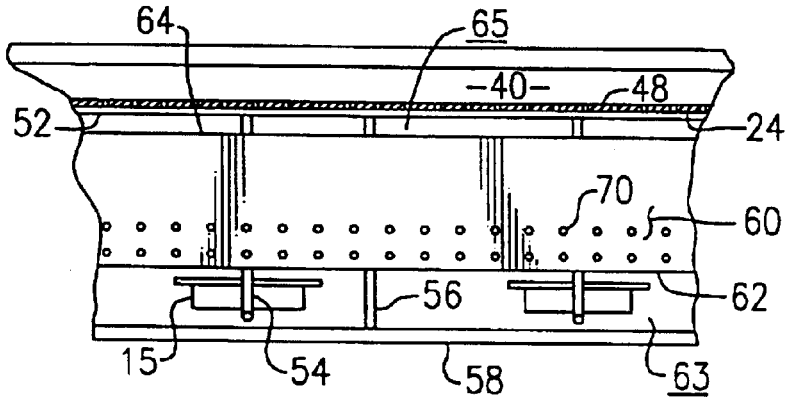
FIG. 6 is a plan view of an alternative embodiment of the flow baffle of the peg bar airflow system of the present invention.
Figure 7:
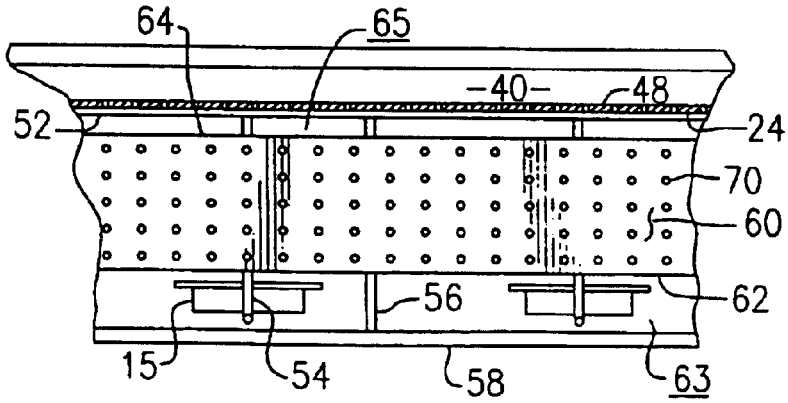
FIG. 7 is a plan view of another alternate embodiment of the flow baffle of the peg bar airflow system of the present invention.

In a further embodiment of the present invention, a plurality of airflow passages 70 extend through the baffle plate 60 through which a portion of the refrigerated air passing over the surface of the baffle plate 60 may pass downwardly through the airflow passages 70 to pass over and cool the product 15 hanging on the product support rods 54 of the peg bar support system 50 lying subadjacent the baffle plate 60. In one embodiment, as illustrated in FIG. 6, the airflow passages comprise a plurality of holes 70 congregated in a forward portion 68 of the baffle plate 60 lying along the forward edge 62 of the baffle plate 60. In alternative embodiment, as illustrated in FIG. 7, the airflow passages comprise a plurality of holes 70 distributed evenly over the surface of the baffle plate 60. It is to be understood, however, that the airflow passages 70 may be of any size, of any shape, such as slots, and be distributed in any desired pattern over the baffle plate 60.

The aforementioned description, in which the preferred embodiments of the invention have been disclosed, is exemplary in nature, rather that limiting. Those skilled in the art will recognize that various modifications and alterations of the present invention are possible in light of the above teachings, without departing from the scope of the invention. It is to be understood that the invention may be practiced within the scope of the appended claims, but otherwise than as specifically described in the detailed description hereinbefore presented.

What is claimed is:

1. A refrigerated merchandiser comprising:

a display case defining a product display space having an open front, the display case having a back panel having air inlet holes extending therethrough through which refrigerated air enters the display area;

a peg bar support system disposed within the display space, the peg bar system having a support bar supported from the back panel of the display case, a first set of rods extending from the support bar into the display space to support a tag moulding at the distal ends of said set of first rods, and a set of second rods extending from the support bar into the display space and adapted to provide support for a product to hang therefrom; and a baffle plate disposed superadjacent the peg bar support system, the baffle plate having a leading edge and a trailing edge, the leading edge of the baffle plate positioned in spaced relationship from the tag moulding thereby establishing an airflow gap therebetween.

2. The refrigerated merchandiser of claim 1 wherein the baffle plate has a plurality of airflow passages passing therethrough.

3. The refrigerated merchandiser of claim 2 wherein the plurality of airflow passages comprises a plurality of holes perforating the baffle plate.

4. The refrigerated merchandiser of claim 2 wherein the plurality of airflow passages comprises a plurality of holes perforating a forward portion of the baffle plate extending along the leading edge of the baffle plate.

5. The refrigerated merchandiser of claim 2 wherein the plurality of holes perforating the baffle plate are substantially evenly distributed over the baffle plate.

6. The refrigerated merchandiser of claim 1 wherein the trailing edge of the baffle plate is positioned in spaced relationship with the back panel of the display case thereby forming an airflow gap therebetween.

7. The refrigerated merchandiser of claim 6 wherein the baffle plate has a plurality of airflow passages passing therethrough.

8. The refrigerated merchandiser of claim 7 wherein the plurality of airflow passages comprises a plurality of holes perforating the baffle plate.

9. The refrigerated merchandiser of claim 7 wherein the plurality of airflow passages comprises a plurality of holes perforating a forward portion of the baffle plate extending along the leading edge of the baffle plate.

10. The refrigerated merchandiser of claim 7 wherein the plurality of holes perforating the baffle plate are substantially evenly distributed over the baffle plate.

* * * * *